US006321691B1

(12) United States Patent
Harth, III

(10) Patent No.: US 6,321,691 B1
(45) **Date of Patent: *Nov. 27, 2001**

(54) OXIDATION RESISTANT LOW ALLOY ATTACHMENTS FOR BOILER COMPONENTS

(75) Inventor: George H. Harth, III, Wadsworth, OH (US)

(73) Assignee: The Babcock & Wilcox Company, New Orleans, LA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/231,914

(22) Filed: Jan. 14, 1999

(51) Int. Cl.[7] ..... F22B 37/24

(52) U.S. Cl. ..... 122/510; 122/511; 165/67; 165/81

(58) Field of Search ..... 122/510, 511, 122/DIG. 13, 6 A; 165/162, 81, 67

(56) References Cited

U.S. PATENT DOCUMENTS

| | | | | |
|---|---|---|---|---|
| 2,809,616 | * | 10/1957 | Black | 122/478 |
| 3,708,142 | * | 1/1973 | Small | 138/112 |
| 4,041,907 | * | 8/1977 | Chayes | 122/510 |
| 4,453,501 | * | 6/1984 | Hayes et al. | 122/510 |
| 4,550,777 | * | 11/1985 | Fournier et al. | 165/162 |
| 4,716,857 | * | 1/1988 | Moreau | 122/6 A |
| 4,848,452 | * | 7/1989 | McDonald et al. | 165/178 |
| 4,904,501 | * | 2/1990 | Davis | 427/253 |
| 5,041,309 | | 8/1991 | Davis et al. | 427/217 |
| 5,058,534 | * | 10/1991 | Pohl et al. | 122/6 A |
| 5,092,278 | * | 3/1992 | Gold et al. | 122/6 A |
| 5,135,777 | | 8/1992 | Davis et al. | 427/217 |
| 5,136,985 | * | 8/1992 | Krowech | 122/510 |
| 5,141,049 | * | 8/1992 | Larsen et al. | 165/133 |
| 5,207,184 | * | 5/1993 | Kreider | 122/510 |
| 5,364,659 | | 11/1994 | Rapp et al. | 427/253 |
| 5,404,941 | * | 4/1995 | Jacksits | 165/162 |
| 5,492,727 | | 2/1996 | Rapp et al. | 427/253 |
| 5,534,313 | * | 7/1996 | Kung et al. | 427/543 |
| 5,589,220 | | 12/1996 | Rapp et al. | 427/126.1 |
| 5,912,050 | * | 6/1999 | Zeigler et al. | 427/252 |

* cited by examiner

*Primary Examiner*—Jiping Lu
(74) *Attorney, Agent, or Firm*—Eric Marich; Kathryn W. Grant

(57) ABSTRACT

A boiler attachment used to support a boiler component within the furnace or boiler chamber is composed of a similar material to the boiler component it is welded to, in order to eliminate the dissimilar weld failure. The boiler attachment is coated using a diffusion coating method to cover the attachments with a coating of aluminum, chromium, silicon or a combination thereof.

11 Claims, 1 Drawing Sheet

OXIDATION RESISTANT LOW ALLOY ATTACHMENTS FOR BOILER COMPONENTS

FIELD AND BACKGROUND OF THE INVENTION

1. Field of the Invention

The present invention relates generally to the field of industrial boilers and furnaces and in particular to new and useful boiler components and attachments having matched materials to improve weld quality and extend the lifespan of the components inside a boiler or furnace.

2. Description of the Related Art

Presently, attachments for boiler components such as superheaters and reheaters which operate in the higher temperature regions of boilers are made of stainless steel materials. Attachments are used to secure the components within the boiler or furnace and include handcuff supports, tie bars and end support lugs. Stainless steel materials are utilized to help resist oxidation of the attachment when exposed to the high operating temperatures.

Ferritic low alloy materials cannot withstand the highly oxidizing environment for long periods of time, and so the use of these materials is limited to locations where temperatures are lower. Commonly, ferritic low alloy materials used in boiler applications are materials such as SA213T22 or SA213T91.

When stainless steel attachments are welded to ferritic low alloy material boiler components, the welds are subject to failure because of the differences in materials. Dissimilar metals do not form as strong welded bonds as when the metals are matched. This dissimilar metal failure mode is common in boiler applications where stainless steel is welded to a ferritic material.

Weld failures cause maintenance problems for the boiler owner or operator, since the weld failures must be repaired on a regular basis to avoid greater damage to unsupported or misaligned boiler components. But, using similar materials for the boiler components and attachments may result in failures of the attachments due to oxidation at elevated temperatures.

Chromizing is a process of producing a chromium diffusion coating on ferrous-base components to improve corrosion resistance, especially at elevated temperatures. Chromizing was developed to produce an integral protective surface coating on components exposed to extreme conditions to enhance their usable life.

Chromizing of parts such as bolts, screws, studs and the like is commonly accomplished using a powder pack cementation technique. The parts are packed into dry powder mixtures of aluminum oxide, chromium, and activator salts within a retort, which is then sealed and heated. During the heating, the temperature of the retort is raised to an elevated level and held for a predetermined amount of time. A chemical reaction takes place during the heating process which causes a surface layer of high chromium content to be diffused into the iron of the ferrous-based parts. The retort and parts are cooled and the parts, now with a layer of chromium coating are removed from the retort.

The pack cementation method has significant drawbacks when used to coat such small, individual parts. The coating thicknesses often vary widely between individual coated parts, or even across the surfaces of larger parts. This is caused by the poor thermal conductivity of the powder pack and the resulting very slow and non-uniform heating rates for the packed parts. Another drawback of this process is that if the parts come into direct contact with each other, the chromium coating diffusion bonds the parts together at these contact points. Further, a large volume of powder waste is generated by the process.

U.S. Pat. No. 4,904,501 discloses an improved method of chromizing the surface of a ferritic boiler component which involves applying aqueous coating compositions containing chromium directly to the surface to be chromized. The aqueous compositions include chromium, alumina, a binder of ammonium alginate or methyl cellulose and a halide activator.

Other processes for coating parts are taught by U.S. Pat. No. 5,135,777, U.S. Pat. No. 5,041,309, U.S. Pat. No. 5,364,659, U.S. Pat. No. 5,492,727 and U.S. Pat. No. 5,589,220.

An improved method of coating small parts, such as bolts, screws and studs, and which could be adapted for use to coat boiler attachments is disclosed in U.S. patent application Ser. No. 08/938,319 filed Sept. 26, 1997, the disclosure of which is incorporated herein by reference.

SUMMARY OF THE INVENTION

It is an object of the present invention to provide boiler attachments and components which overcome the problems associated with dissimilar metal weld failures, while having oxidation and heat resistance properties suitable for the boiler or furnace region.

Accordingly, a boiler attachment of the invention is composed of a similar material as the boiler component that it is welded to eliminate the dissimilar weld failure. The boiler attachment is coated using a diffusion method to cover the attachments with a coating of aluminum, chromium, silicon or a combination thereof. The boiler attachment can then be welded to a boiler component of the same material without resulting in dissimilar metal weld failures. Further, the coated attachment is capable of resisting the high temperature environment, despite the incompatibility of the underlying material with that environment. Thus, a boiler component with compatible weld material components is provided.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
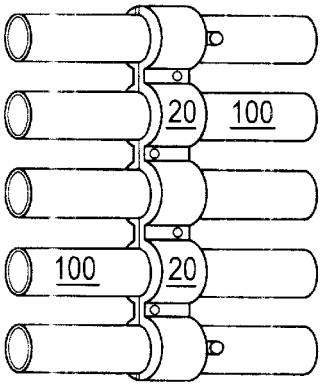
FIG. 1 is a perspective view of handcuff-type attachments connected to boiler tubes.
Figure 2:
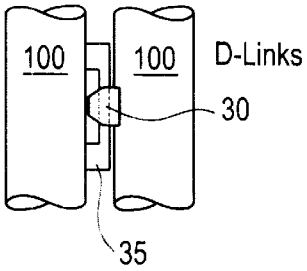
FIG. 2 is a side elevational view of a D-link attachment for boiler tubes.
Figure 5:
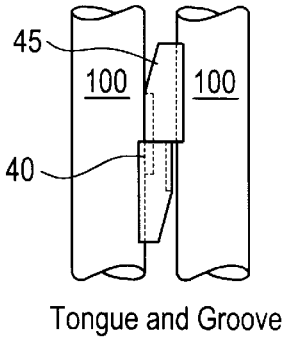
FIG. 5 is a side elevational view of the attachment of FIG. 4.
Figure 3:
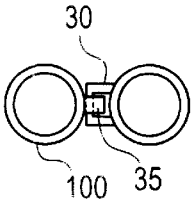
FIG. 3 is a top plan view of the D-link attachment of FIG. 2.
Figure 4:
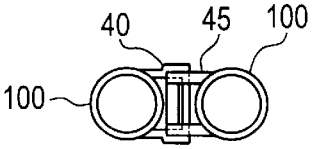
FIG. 4 is a top plan view of a tongue and groove attachment.

Referring now to the drawings, in which like reference numerals are used to refer to the same or similar elements; FIGS. 1–5 show different types of attachments for connecting boiler tubes 100 together, such as in a reheater or superheater tube bank. Attachments for boilers include several different types of hardware, including handcuff supports 20, tongue and groove connectors 40, 45 and D-link connectors 30, 35, as well as tie bars and end plugs (not shown).

Figure 6A:
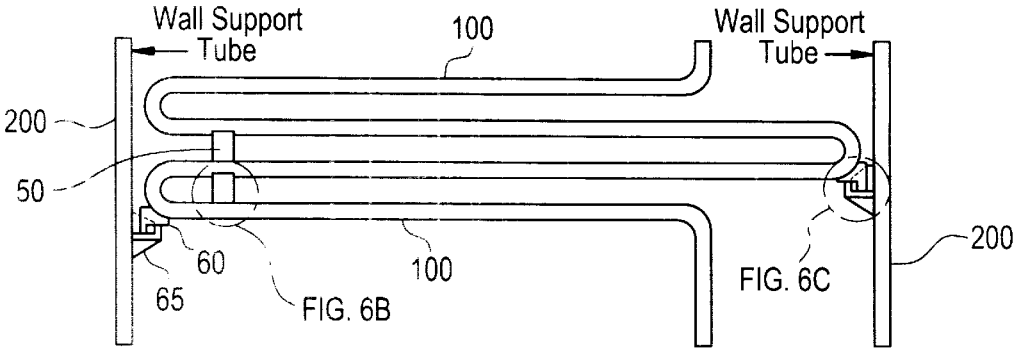
FIG. 6A is a side elevational view of superheater tubes supported in a boiler.
Figure 6B:
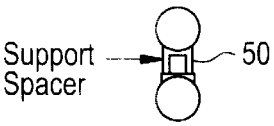
FIG. 6B is an enlarged end view of a spacer attachment used in the supports of FIG. 6A.
Figure 6C:
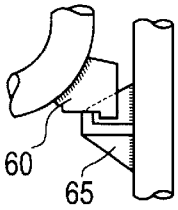
FIG. 6C is an enlarged side elevational view of a support attachment used to support the tubes in FIG. 6A.

FIGS. 6A–C show different attachments which can be used to support the tubes 100 on furnace or boiler walls 200 or simply to space the tubes 100 from each other. Support spacers 50 help maintain specific distances between tubes 100. End hooks 60 connected to the tubes 100 rest on wall supports 65 which are attached to the walls 200 to suspend the superheater or reheater tubes 100 in the desired furnace or boiler region.

In each case, the attachments shown in FIGS. 1–6C may be welded to the tubes 100.

In order to overcome the weld strength limitations caused by using materials which are incompatible with the boiler components, such as tubes 100, to make attachments, the material used to make the various connectors 20, 30, 35, 40, 45 and supports 50, 60, 65 is made of a material similar to the material of the tube 100. Typically, if a ferritic steel boiler component, such as a tube 100 is used, then a ferritic steel would be selected as the attachment material. In cases where stainless steel is used for the boiler component, the attachment may also be stainless steel. Thus, the attachment may be welded to the tube 100 or other component without increasing the likelihood of weld failure due to incompatible materials. Matching materials is done by using materials of similar composition, or chemistry, and having similar coefficients of thermal expansion.

The attachment can be coated using a diffusion coating process to cover the attachment to protect it with a chromium, silicon or aluminum oxidation resistant coating. Any suitable coating process may be used, provided a uniform coating of the attachments is obtained.

For example, where a boiler tube 100 is made of a ferritic material, a handcuff support 20 is selected which is made of a ferritic material also. Prior to welding the support 20 to the tube 100, the support is coated with a chromium, silicon or aluminum coating by placing the support 20 in a retort, spraying the support 20 with a slurry of the coating material, allowing the slurry to dry while sealing the retort and heating the retort to coat the support 20. The coated support 20 can then be welded to the tube 100 and used in a boiler without problems associated with incompatible welding materials and having good resistance to oxidation and corrosion.

While a specific embodiment of the invention has been shown and described in detail to illustrate the application of the principles of the invention, it will be understood that the invention may be embodied otherwise without departing from such principles.

What is claimed is:

1. An attachment for welding to one of a superheater and reheater boiler component composed of a first material, comprising:

support means for holding the one of the superheater and reheater boiler component in a position within an industrial furnace or boiler made of one of the first material and a second material having a similar coefficient of thermal expansion and chemistry as the first material, the support means being coated by a diffusion coating with a coating of one of aluminum, chromium, silicon, and mixtures thereof.

2. The attachment according to claim 1, wherein the support means comprises one of a handcuff connector, a D-link connector, a tongue and groove connector, a support spacer and end hooks and wall supports.

3. The attachment according to claim 2, wherein the first material is a ferritic steel material.

4. The attachment according to claim 3, wherein the second material is a ferritic steel material.

5. The attachment according to claim 2, wherein the first material is stainless steel.

6. The attachment according to claim 5, wherein the second material is stainless steel.

7. The attachment according to claim 2, wherein the coating is aluminum.

8. The attachment according to claim 2, wherein the coating is chromium.

9. A superheater or reheater boiler component for use in an industrial boiler or furnace having improved functional life and structural stability in high temperature regions, the superheater or reheater boiler component comprising:

a plurality of tubes composed of a first material; and welded attachment means for supporting the plurality of tubes in a position within the industrial furnace or boiler, made of one of the first material and a second material having a similar coefficient of thermal expansion and chemistry as the first material, and being coated by a diffusion coating with a coating of one of aluminum, chromium, silicon, and mixtures thereof.

10. The boiler component according to claim 9, wherein the attachment means comprises one of a handcuff connector, a tongue and groove connector, a support spacer and end hooks and wall supports.

11. The boiler component according to claim 9, wherein the first material is a ferritic steel material.

* * * * *